US006774322B2

(12) United States Patent
Morinishi et al.

(10) Patent No.: US 6,774,322 B2
(45) Date of Patent: Aug. 10, 2004

(54) SWITCH DEVICE

(75) Inventors: Yusuke Morinishi, Tokyo (JP); Hirohito Suzuki, Kanagawa (JP); Tomonori Hasegawa, Tokyo (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 10/169,320

(22) PCT Filed: Nov. 7, 2001

(86) PCT No.: PCT/JP01/09732

§ 371 (c)(1),
(2), (4) Date: Dec. 16, 2002

(87) PCT Pub. No.: WO02/39471

PCT Pub. Date: May 16, 2002

(65) Prior Publication Data

US 2003/0136651 A1 Jul. 24, 2003

(30) Foreign Application Priority Data

Nov. 7, 2000 (JP) ..... 2000-339124

(51) Int. Cl.[7] ..... H01H 9/00

(52) U.S. Cl. ..... 200/5 R; 200/4; 200/14

(58) Field of Search ..... 200/4, 5 R, 6 A, 200/17 R, 18, 14

(56) References Cited

U.S. PATENT DOCUMENTS

| | | | | | |
|---|---|---|---|---|---|
| 4,590,338 | A | * | 5/1986 | Suzuki | 200/5 R |
| 5,412,165 | A | * | 5/1995 | Malone et al. | 200/5 R |
| 5,689,095 | A | * | 11/1997 | Kawase | 200/5 R |
| 5,923,007 | A | * | 7/1999 | Emmert | 200/5 R |
| 6,291,782 | B1 | * | 9/2001 | Isikawa | 200/14 |
| 6,333,473 | B1 | * | 12/2001 | Sawada et al. | 200/4 |

* cited by examiner

*Primary Examiner*—Michael A. Friedhofer
(74) *Attorney, Agent, or Firm*—Jay H. Maioli

(57) ABSTRACT

A switch device in which two operators are aligned with another operator in between, and a switch device having a dial section (a middle operator) of a jog dial and operation buttons (outer operators) of two operation button switches placed closely to one anther with the dial section in between, and an operation plane of the operation button is formed on a slanted plane that becomes higher the further it is from the jog dial section.

4 Claims, 12 Drawing Sheets

SWITCH DEVICE

TECHNICAL FIELD

The present invention relates to a switch device having three operators aligned in one direction, and a technology for improving its operability.

BACKGROUND ART

Conventionally, in a handy electronic apparatus such as a portable telephone and the like, a so-called jog dial is employed as a switch device for making selections, and the like, from a plurality of items (processes).

Also, there are switch devices, which have two push button switches aligned with the jog dial mentioned above in between, for confirming and executing the selection made from predetermined items through the jog dial mentioned above.

However, the jog dial and the two push button switches have the problem of poor operability.

That is, operation of the jog dial and operation of the two push button switches are usually carried out by using the same finger (for example, the thumb). However, no particular improvements are applied to the relationship (shape, relative position and the like) between the operators for the push button switches and the dial section (operator) of the jog dial. When operating the push button switch subsequent to an operation of the jog dial, the finger used to operate the jog dial must be moved away from the dial section, and it must be shifted to the operator of the push button switch. Thus, its operability is poor.

Also, when the three operators are closely arranged, there is a problem in that so-called simultaneous pushes, or accidents in which two adjacent operators are pushed simultaneously, happen frequently.

Therefore, the present invention makes it an issue to improve the operability of the operators in the above-mentioned switch device in which two operators are aligned with one operator in between, and also to prevent simultaneous pushes of a plurality of operators.

DISCLOSURE OF THE INVENTION

So, in order to solve the above-mentioned problems, a switch device according to the present invention is a switch device having a middle operator and two closely placed outer operators positioned to both sides of the middle operator, and is one in which an operation plane of each of the outer operators is formed with a slanted plane which becomes higher the further it is from the middle operator.

Thus, in the switch device according to the present invention, the outer operators adjacent to the middle operator can be operated just by putting a finger pad on the middle operator and then shifting the finger as if to roll it over the middle operator. Hence, it is possible to improve the operability, by one finger, of the switch device having three operators.

Also, in another switch device according to the present invention, the outer operators are rotatably provided on a rotation shaft which is substantially orthogonal to the alignment of the three operators, and substantially orthogonal to the direction in which operation planes are pressed, and further, the rotation shaft is placed on a side of the outer operator closer to the middle operator.

Thus, in another switch device according to the present invention, when the middle operator is operated, the outer operator can not be operated, and when the outer operator is operated, the middle operator can not be operated. Hence, it is possible to prevent so-called simultaneous pushes.

BEST EMBODIMENTS TO PRACTICE THE INVENTION

Figure 1:
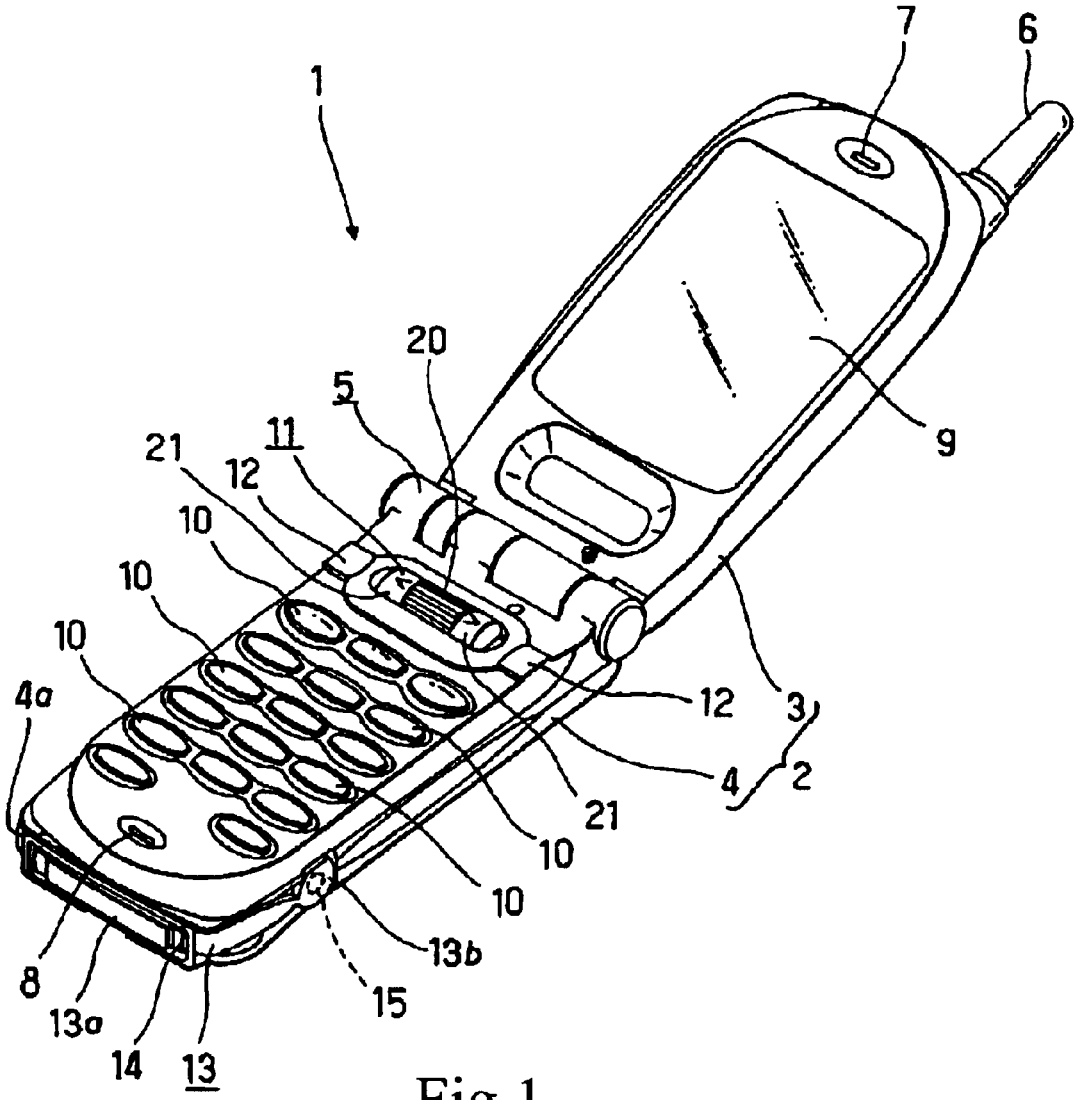
FIG. 1, along with FIGS. 2 to 4, shows the whole body of a folding portable telephone to which the switch device according to the present invention is applied, and the present drawing is a perspective view showing a condition where an upper case and a lower case are opened.
Figure 2:
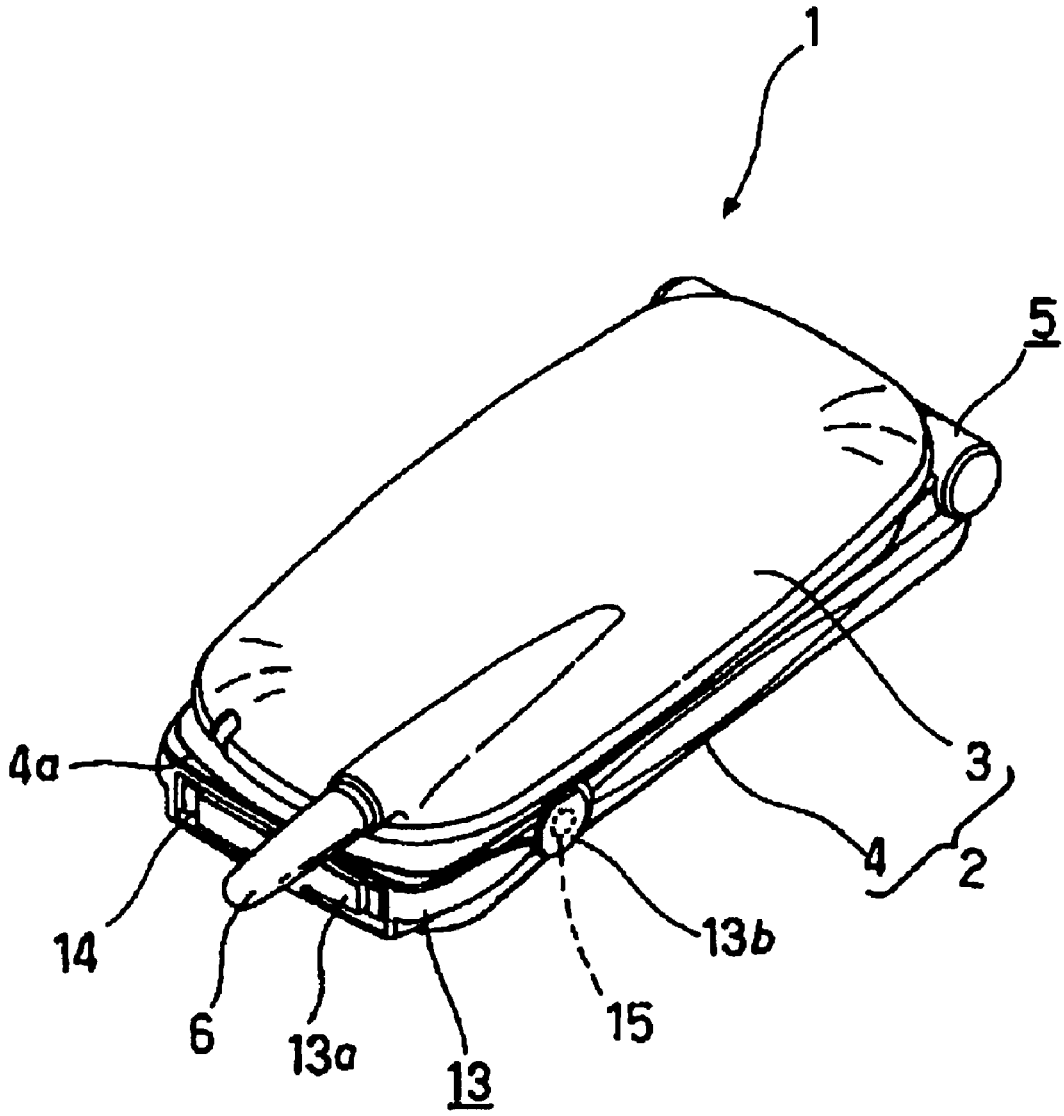
FIG. 2 is a perspective view showing a condition where the upper case and the lower case of the portable telephone in FIG. 1 are folded.
Figure 3:
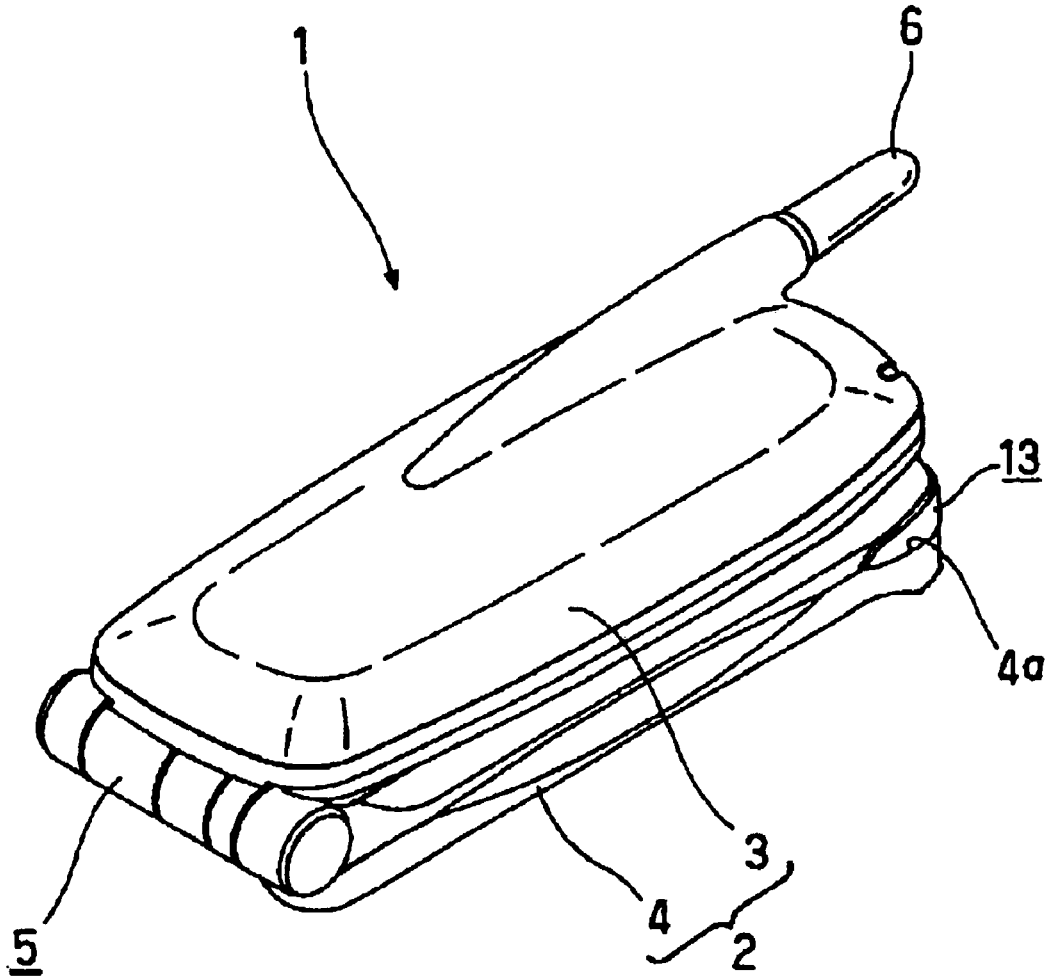
FIG. 3 shows a condition where the upper case and the lower case of the portable telephone in FIG. 1 are folded, and it is a perspective view from a direction different from that of FIG. 2.
Figure 4:
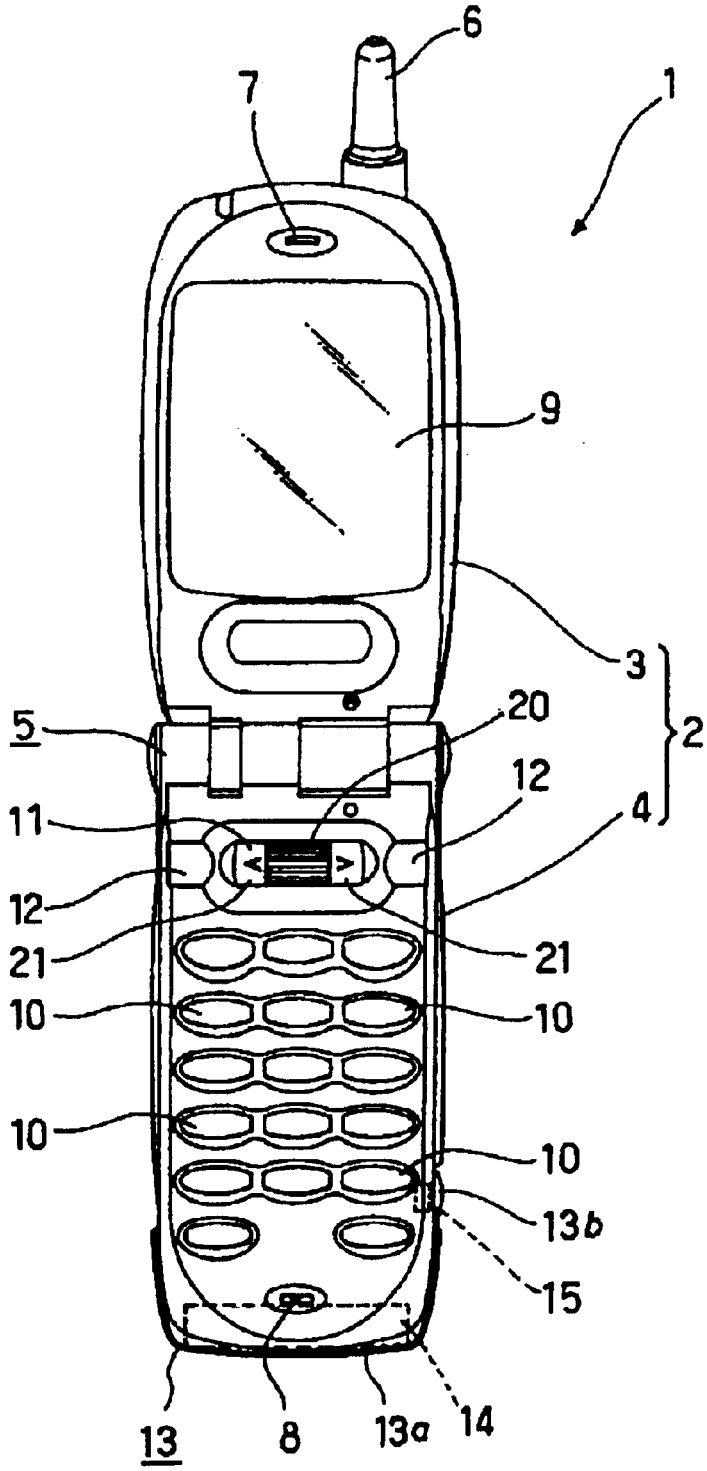
FIG. 4 is a front view showing a condition where the upper case and the lower case of the portable telephone in FIG. 1 are opened.
Figure 5:
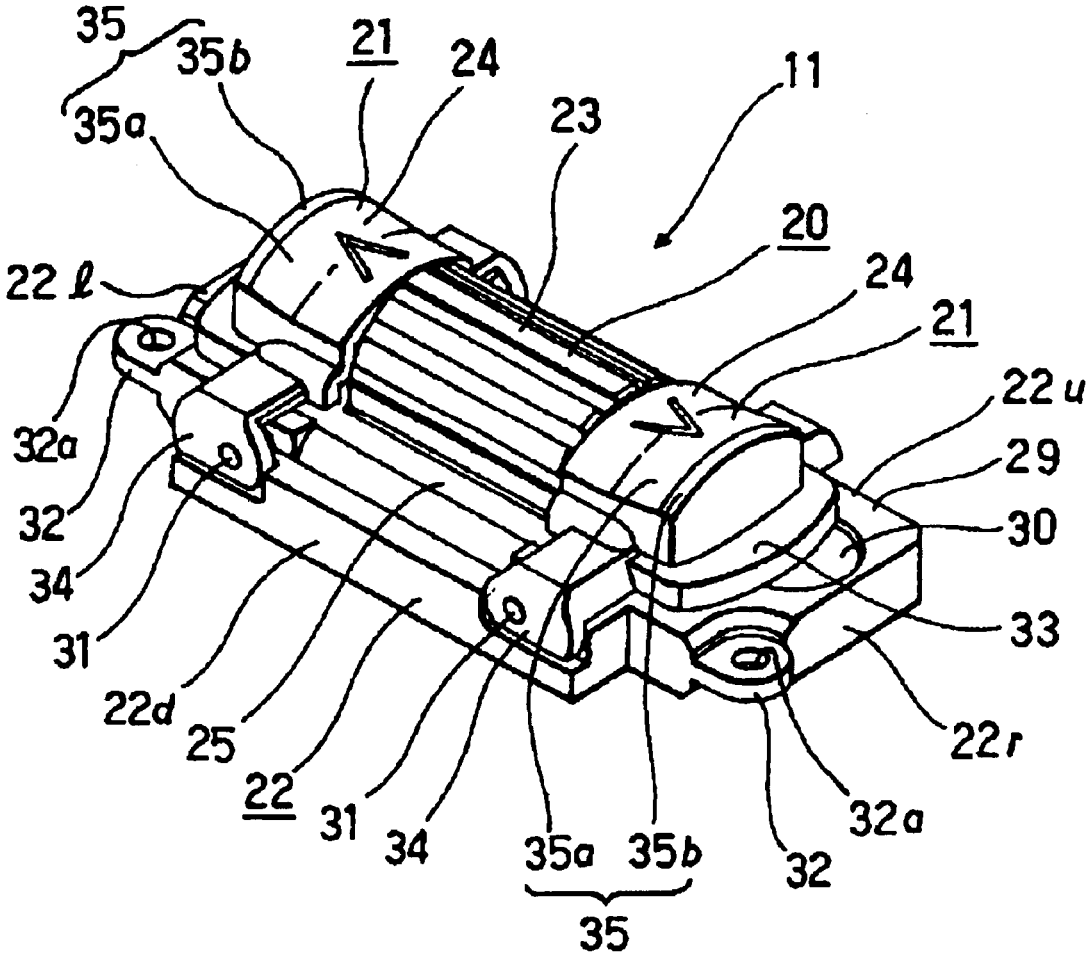
FIG. 5, along with FIGS. 6 to 9, shows a switch device according to the present invention, and the present drawing is a perspective view.
Figure 6:
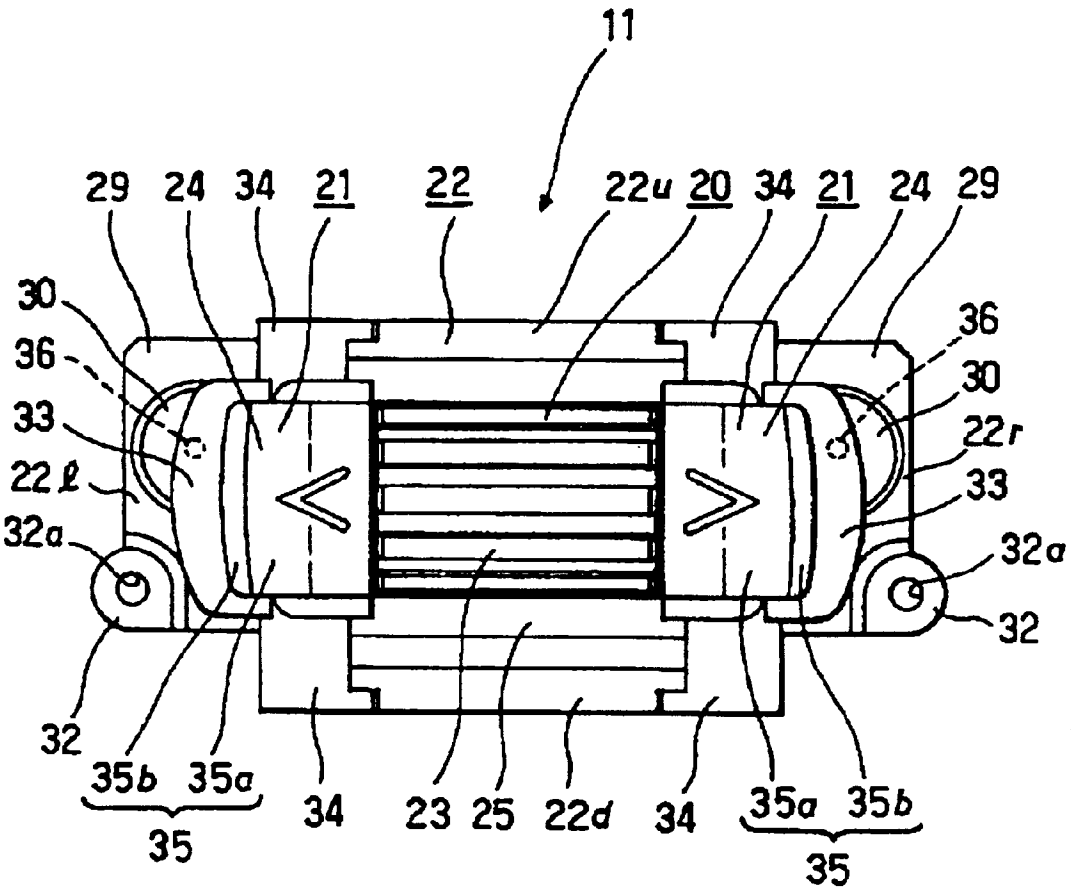
FIG. 6 is a front view of the switch device of FIG. 5.
Figure 7:
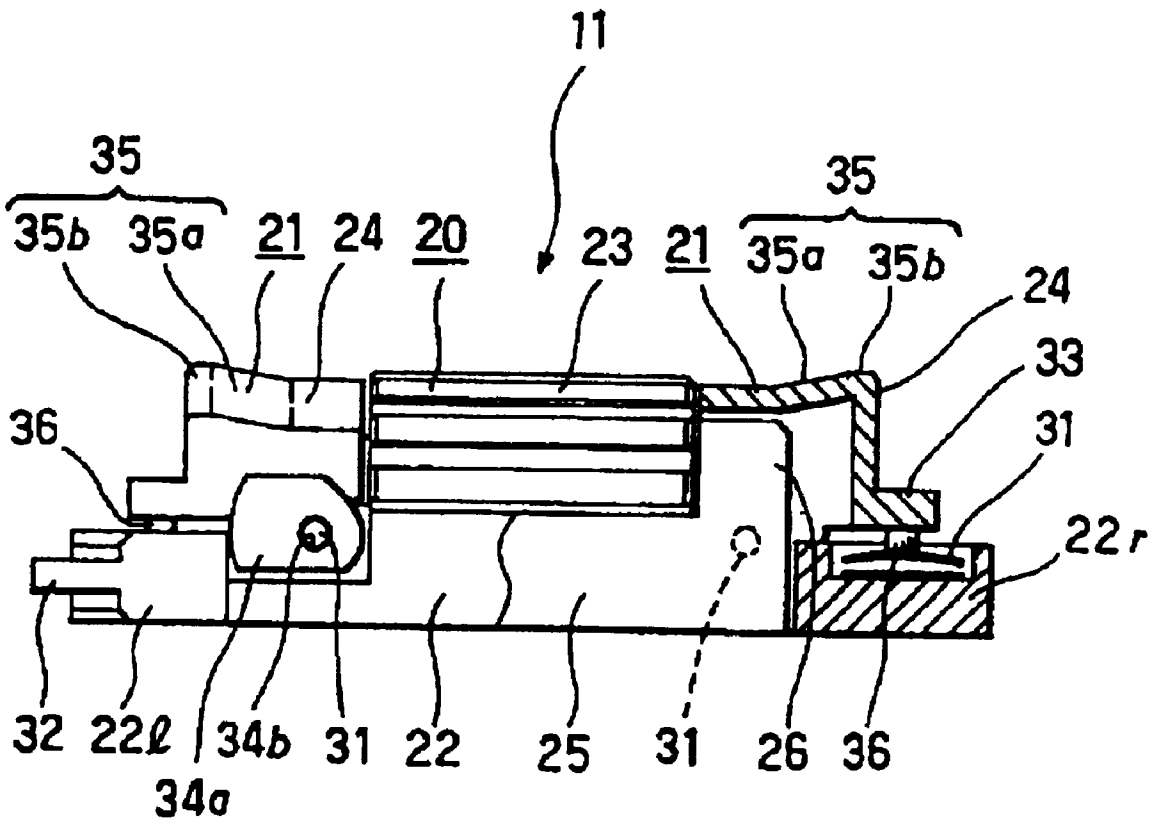
FIG. 7 is a bottom view showing the switch device of FIG. 5 with a part thereof cut away.
Figure 8:
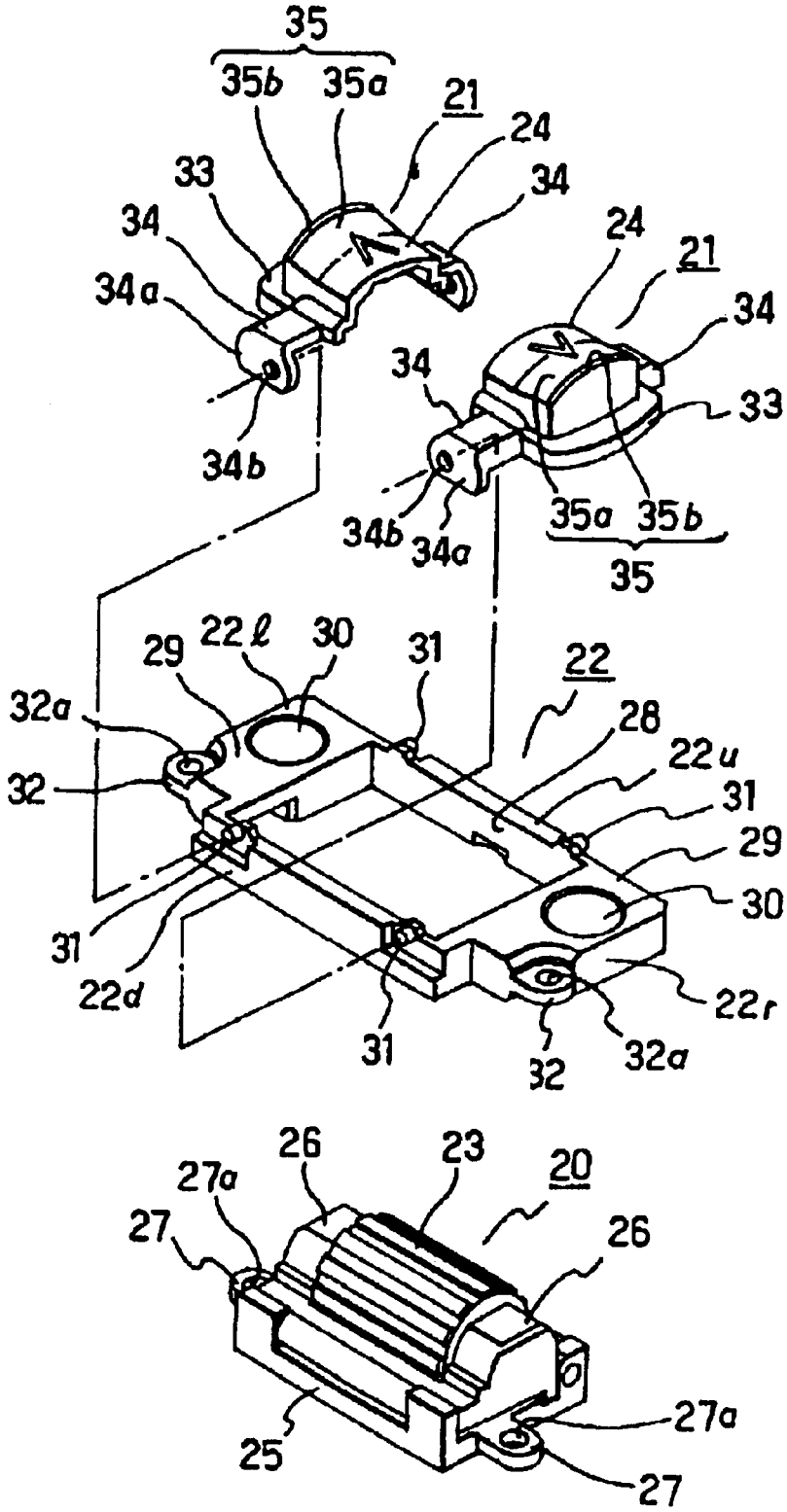
FIG. 8 is an exploded perspective view of the switch device of FIG. 5.
Figure 9:
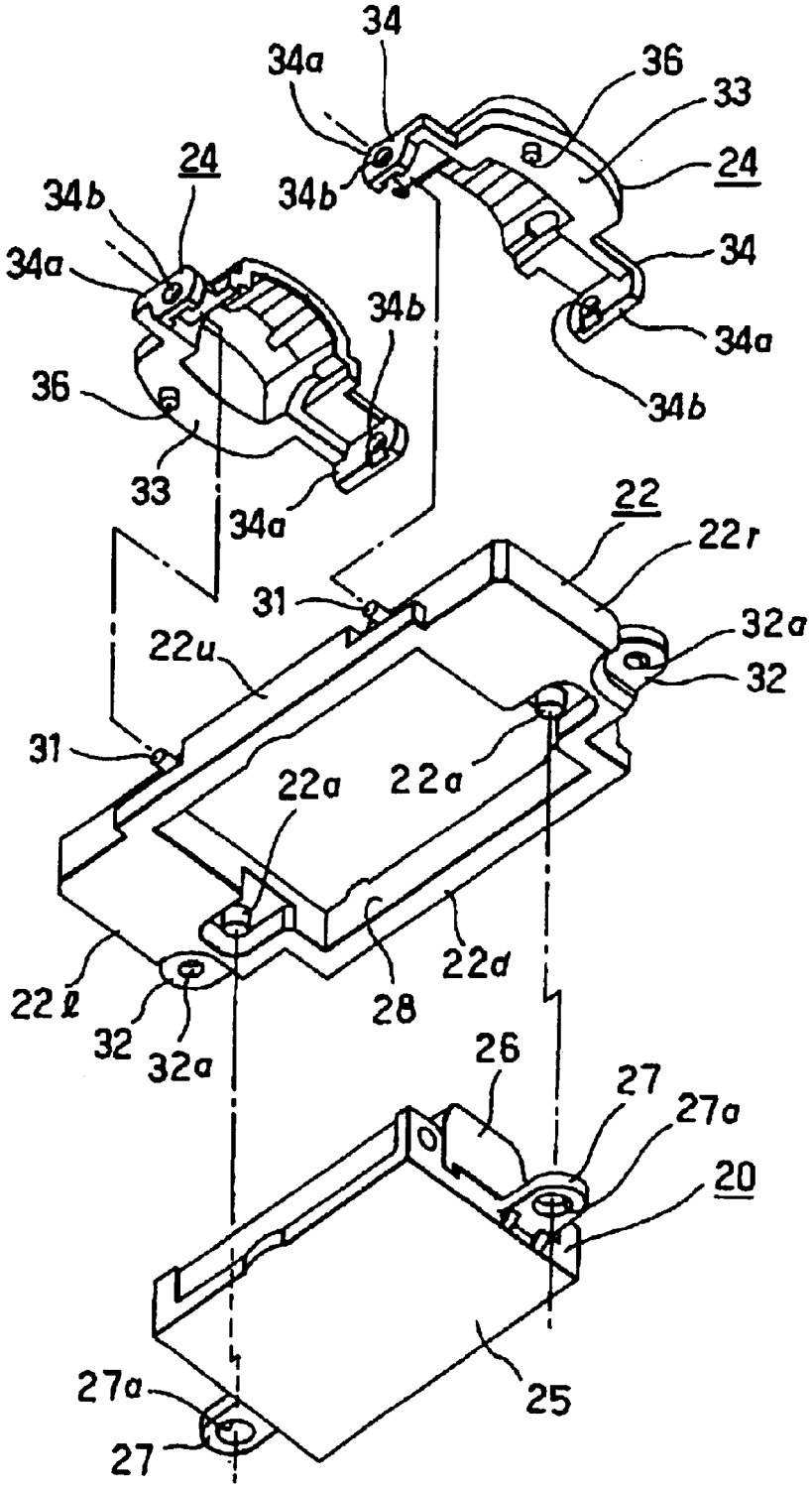
FIG. 9 is an exploded perspective view from a direction different from that of FIG. 8.

Details of a switch device according to the present invention are described below with reference to embodiments illustrated in the attached drawings.

By the way, each embodiment shown in drawing is a switch device, to which the switch device of the present invention is applied, of a mobile phone having a jog dial and two operators closely positioned to both sides of a dial section, which is an operator of the jog dial.

First, a portable telephone serving as a handy electronic apparatus employing a switch device according to the present invention is schematically described with reference to FIGS. 1 to 4.

A portable telephone 1 has a body case 2 made of synthetic resin, and various members are accommodated in or attached to the body case 2.

In the body case 2, a lower end of an upper case 3 and an upper end of a lower case 4 are linked to each other through a hinge 5. Both of the cases 3, 4 are freely rotatable between a closed condition where the respective fronts are engaged with each other and an opened condition where the fronts of both of the cases 3, 4 are visible. By the way, in the opened condition for both of the cases 3, 4, an angle between the respective fronts of both of the cases 3, 4 is set at about 160 degrees. Under such a condition, a part of the lower end of the upper case 3 and a part of the upper end of the lower case 4 meet each other, and the above-mentioned opened angle between both of the cases 3, 4 is thereby regulated.

An antenna 6 is attached to the upper portion of the upper case 3 so that it can be freely pulled out and accommodated. Then, electric waves are transmitted to and received from a base station through the antenna 6.

A speaker 7 serving as an electro-acoustic transducing means is placed on the front and upper portion of the upper case 3. During a telephone conversation, audio from a conversation partner is outputted from this speaker 7.

A microphone 8 serving as an acoustic-electric transducing means is placed on the front and lower portion of the lower case 4. During a telephone conversation, audio from a user is collected by this microphone 8.

A liquid crystal display (LCD) 9 serving as a display means is placed on a large proportion of an area on the front of the upper case 3. It is designed so as to be able to indicate various information, such as signal strength, remaining amount of battery, telephone number of a conversation partner, contents registered in a telephone book (telephone number and name of the person on line and the like), transmission and reception history, other various registered contents, and the like.

Various operation keys 10, 10, . . . serving as input operating means are placed on a large proportion of an area on the front of the lower case 4 except an upper portion and a lower portion. A depression operation of these operation keys 10, 10, . . . enables inputting of various commands, characters and the like.

A switch device 11 serving as an input operating means different from the above-mentioned operation keys 10, 10, . . . is placed on a front and upper portion of the lower case 4.

Push button switches 12, 12 serving as further different input operating devices are placed at positions on the lower case 4 which are slightly separated to the right and left sides of the switch device 11.

An opening 4*a* is formed on a bottom plane and lower portions of both side planes of the lower case 4, and a protection member 13 made of elastomer is attached so as to cover the lower opening 4*a* from below and from both sides.

An interface connector (IF connector) 14 is placed within the lower opening 4*a* of the lower case 4 so as to protrude slightly downward from the lower opening 4*a*.

An earphone jack 15 is placed at a position on the right side of the lower opening 4*a*, and the position is slightly above the lower end thereof.

In addition, the protection member 13 attached on the lower end of the lower case 4 is formed in such a size that covers the lower opening 4*a* of the lower case 4 as well as the IF connector 14. Moreover, a connector cover section 13*a* for blockading the IF connector 14 and an earphone jack cover section 13*b* for blockading the earphone jack are integrated into a single unit.

As shown in detail in FIGS. 5 to 9, the switch device 11 is provided with a jog dial 20, right and left operation button switches 21, 21 and a rectangular frame 22 for unitizing the jog dial 20 and the right and left operation button switches 21, 21. Operation buttons 24, 24 serving as operators for the operation button switches 21, 21 are positioned to the right and left directions of a dial section 23 which serves as an operator of the jog dial 20. The dial section 23 corresponds to a middle operator, and the operation button switches 21, 21 correspond to the outer operators.

The jog dial 20 includes the dial section 23 mentioned above having a cylindrical shape, and a base plate 25 shaped as a slightly thick plate, and having a concave section into which approximately one-third of the lower side of the dial section 23 laid in the center thereof is accommodated. Support bearing sections 26, 26 for rotatably supporting both the right and left ends of the dial section 23 are fitted on the base plate 25. Also, tongue pieces 27, 27 protruding in the right and left directions are protuberantly formed to link with the frame body 22 of the switch device 11. In addition, various contacts (not shown) are installed within the base plate 25. Also, an encoder and the like are built into the support bearing sections 26, 26.

Then, execution of a rotational operation of the dial section 23 of the jog dial 20 enables scrolling of various indication items, such as a menu displayed on the liquid crystal display 9, a transmission and reception history list, a telephone book list and the like, as well as displaying of an item selection cursor and the like.

Also, the jog dial 20 is made such that by way of a depression operation towards the inner direction of the lower case 4, it is possible to confirm or execute an item displayed on the liquid crystal display 9.

Moreover, it is also possible to select or execute predetermined items by operating the right and left operation button switches 21, 21. For example, by operating the operation button switches 21, 21, it is possible to cancel (clear) an item which has been confirmed by the above-mentioned depression operation, or by the depression operation mentioned above, it is possible to go up the menu layer by one level during display of the menu, or to display a call-waiting menu if the user is on the phone.

By having small holes 27*a*, 27*a* formed on the tongue pieces 27, 27 of the base plate 25 externally engaged with small protrusions 22*a*, 22*a* formed on the rear side of the frame body 22, and by, for example, thermally welding tips of the small protrusions 22*a*, 22*a*, the jog dial 20 is linked to the frame body 22.

On the frame body 22, as mentioned above, a jog dial placement hole 28 is formed in the center surrounded by respective frame pieces 22*u*, 22*d*, 22*r* and 22*l*. The frame pieces 22*r*, 22*l* on the right and left sides of the jog dial placement hole 28 are formed on slightly wide flat portions 29, 29. Circular contact sections 30, 30 are installed to the flat portions 29, 29 at positions that are slightly biased towards the upper side than the center thereof.

Also, protuberant button rotation shafts 31, 31, . . . are protuberantly formed in the right and left ends of the upper and lower frame pieces 22*u*, 22*d* of the frame body 22 (positions closer to the flat portions 29, 29), in upward and downward directions, respectively. Such button rotation shafts 31, 31, . . . are placed at positions, which in the upward and downward directions correspond to the positions of the support bearing sections 26, 26 of the base plate 25 of the jog dial 20.

By the way, in this embodiment, the jog dial 20 and the frame body 22 are designed as separate structures. However, the present invention is not limited as such, and they may be integrated into a single structure.

Also, the button rotation shaft 31 corresponds to the rotation shaft of the outer operator Further, the Direction of Alignment of the Three Operators is the right and left directions in this embodiment. And, the Depression Direction of the Operation Planes is a direction towards the inside of the lower case 4 in this embodiment. Ultimately, in this embodiment, the orientation of the rotation shaft (31) is the direction substantially orthogonal to both of them, namely, the upward and downward directions.

Supported pieces 32, 32, which are tongue-shaped and protrude externally, are formed at positions on the outer edges of the right and left frame pieces 22*r*, 22*l* of the frame body 22, and the positions are slightly closer to the lower portion than the center. Small holes 32*a*, 32*a* are formed on the supported pieces 32, 32, respectively. In the supported pieces 32, 32, after the small holes 32*a*, 32*a* are inserted into small protrusions (not shown) protuberantly formed on the rear side of the front half (reference numerals omitted) of the lower case 4, the tips of the small protrusions are, for example, thermally welded, thereby attaching the switch device 11 inside the lower case 4. And the dial section 23 of the jog dial 20 and the operation buttons 24, 24 of the right and left operation button switches 21, 21 are projected through the surface of the lower case 4.

The right and left operation button switches 21, 21 of the switch device 11 are substantially identical in shape except for their symmetry. Therefore, only the left operation button switch 21 is described, and description of the right operation button switch 21 is omitted by giving the same reference numerals to the corresponding parts and sections.

The operation button switch 21 includes an operation button 24 in which the upper, lower and left sides are blockaded and the outer appearance is substantially semi-cylindrical, a depression piece 33 that is protuberantly formed on the rear edge of the operation button 24 towards the left direction and located in front of the flat portion 29 and supported pieces 34, 34 that are protuberantly formed on the rear edge in upward and downward directions and further protrude from the rear sides at their tip edges.

The operation button 24 is formed in a size that covers the front plane, the upper and lower planes and the left side plane of the support bearing section 26 of the jog dial 20 from a side opposite to the dial section 23. This front plane is an operation plane 35 to be pressed by a finger F, as described later.

On the rear plane of the depression piece 33, a small convex section 36 is formed at a position corresponding to the contact section 30. As described later, when the operation button switch 21 is operated, the small convex section 36 depresses the contact section 30 and turns the operation button switch 21 on.

On the supported pieces 34, 34, small holes 34*b*, 34*b* are formed opposite to each other, and the small holes 34*b*, 34*b* are engaged with the rotation shafts 31, 31 of the frame body 22, respectively. Thus, the operation button switch 21 is rotatably supported by the frame body 22.

By the way, in this embodiment, the operation button switch 21 is rotatably supported by the frame body 22. However, the present invention is not limited thereto. The operation button switch 21 may be rotatably supported by a member on the side of the jog dial 20, for example, the base plate 25 or the support bearing section 26.

In this way, in the rotatably supported operation button switch 21, the operation plane 35 thereof is set to be slightly lower than the dial section 23 of the jog dial 20. Thus, when the switch device 11 is touched with the finger F, it is possible to easily identify which of the operators (the dial 23 and the operation buttons 24, 24) is being touched. In addition, when the dial section 23 is depressed, the dial section 23 and the operation plane 35 of the operation button switch 21 are designed to be substantially equal in height.

Further, the operation plane 35 of the operation button 24 is formed on a slanted plane 35*a*, in which the right edge has an arc in the upward and downward directions, is formed with a curvature substantially equal to or less than the circumference of the dial section 23, and whose extent of protrusion to the surface side increases along the left direction. Also, the left end is formed with a flat plane 35*b* of which the protrusion amount to the surface side is unchanging.

By the way, the terms slanted plane 35*a* and flat plane 35*b* express whether the ridgeline of the operation button 24 is slanted or flat when viewed from below. Actually, the slanted plane 35*a* of the operation plane 35 is formed in the shape of a trumpet such that it expands towards the surface side along the left direction.

Also, in this embodiment, the slanted plane 35*a* is defined as a slanted plane in which, from a point substantially in the middle along the right and left directions of the operation button 24, the extent of protrusion gradually increases. However, the slanted plane is not limited to the above configuration, and may be configured to slant from the edge of the operation button 24 on the side of the jog dial 20.

Then, the operation button switch 21 covers the support bearing section 26 of the jog dial 20 in the inner space of the operation button 24, while it is rotatably supported on the frame body 22, as mentioned above. Thus, the right edge of the operation plane 35 is located close to the left edge of the dial section 23 of the jog dial 20. Also, the small convex section 36 of the depression piece 33 of the operation button switch 21 is in contact with or is close to the contact section 30.

In this way, the switch device 11 in which the jog dial 20 and the right and left operation button switches 21, 21 are unitized is attached to the lower case 4 from an inner side thereof, and the dial section 23 and the right and left operation buttons 24, 24 are arranged so as to protrude slightly from the surface of the lower case 4. Moreover, the jog dial 20 is set to be slightly higher than the operation button switch 21, as mentioned above.

Thus, when the switch device 11 is touched with the finger F, which of the three operators (the dial 23 and the operation button switches 21, 21) is being touched can be easily identified as mentioned above. Hence, this contributes to the improvement of their operability.

Figure 10:
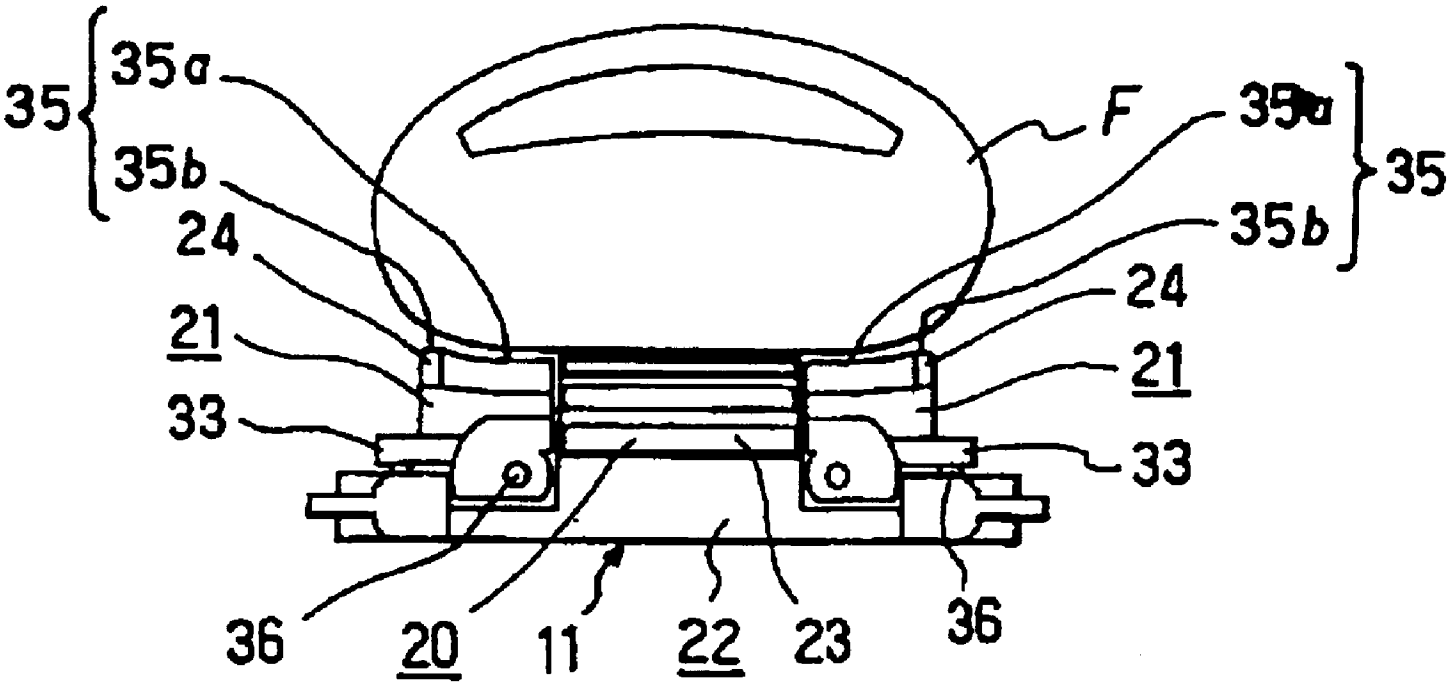
FIG. 10, along with FIG. 11, shows a condition where the switch device is operated with a finger, and the present drawing is a bottom view showing a middle operator being operated.

Then, when the jog dial 20 is operated, as shown in FIG. 10, it is done by rotating the dial section 23 as if to roll it upward and downward by using the pad of the finger F, and by a depression operation towards inside the lower case 4.

Figure 11:
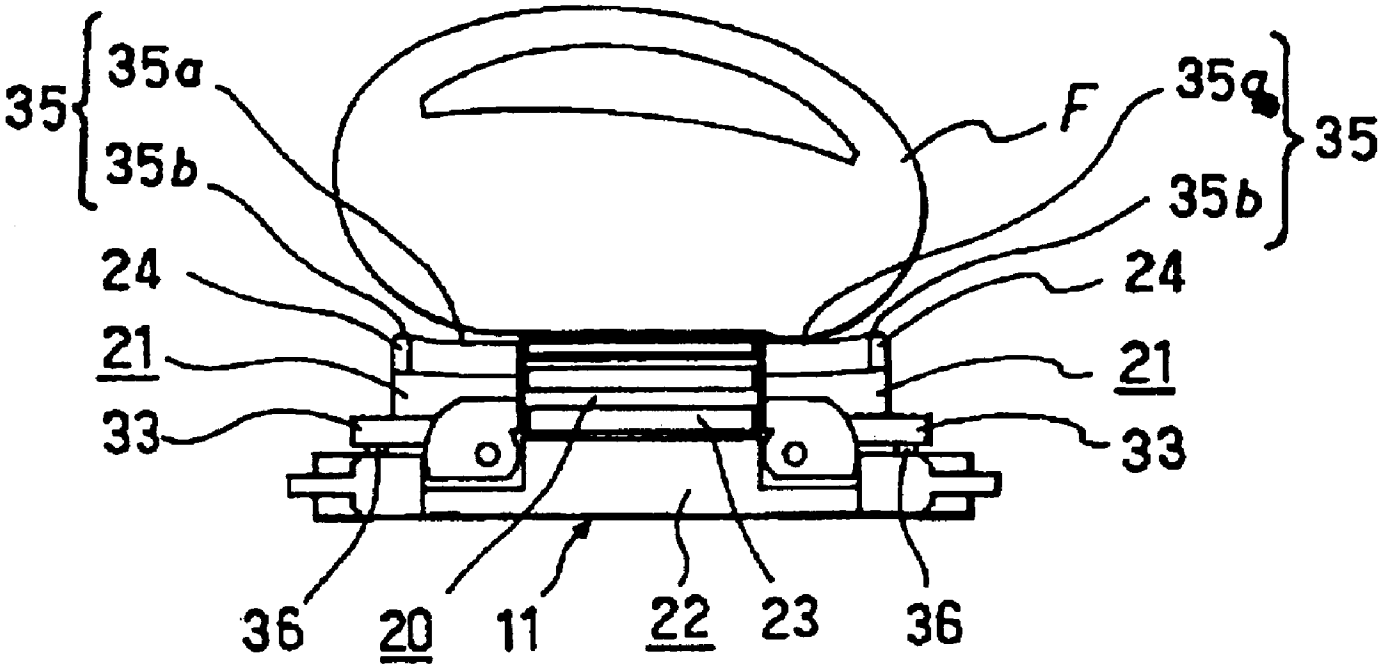
FIG. 11 is a bottom view showing the finger shifting from the middle operator to an outer operator.
Figure 12:
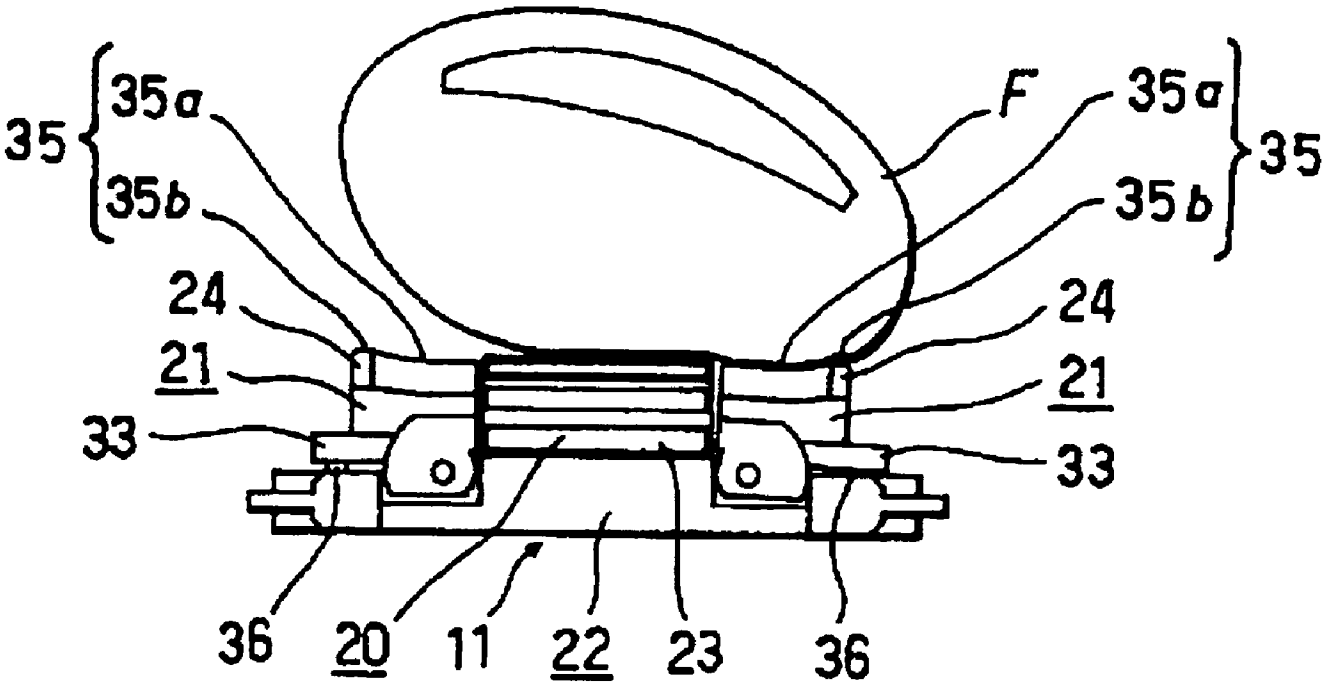
FIG. 12 is a bottom view showing the outer operator being operated.

Also, when the right and left operation button switches 21, 21 are operated, as shown in FIGS. 11 and 12, by shifting the finger F placed on the dial 23 as if to roll it in the right or left direction, and then depressing the operation planes 35, 35 of the operation buttons 24, 24 by using portions of the finger slightly closer to the side than the tab. Then, the depressed operation button switches 21, 21 are rotated around the button rotation shafts 31, 31, and the outer portions (the depression pieces 33, 33) are operated by being depressed towards inside the lower case 4. Thus the small convex sections 36, 36 protuberantly formed on the rear planes of the depression pieces 33, 33 depress the contact sections 30 of the frame body 22, thereby turning on each of the operation button switches 21, 21, separately.

Specifically, when the finger F placed on the dial section 23 is shifted as if to roll in the right or left direction, although the pad of the finger F touches the dial section 23, the portion of the finger F depressing the operation button 24 is shifted in the external direction while touching the slanted plane 35*a* of the operation plane 35 in a rolling manner. Then, when the flesh of the finger F is placed on the flat plane 35*b*, the force on the flat plane 35*b* towards the inside of the lower case 4 increases, thereby rotating the operation button switch 21. Thus, as mentioned above, the small convex section 36 depresses the contact section 30. Hence, such a flat plane 35*b* functions to make operation of the operation button switch 21 easier. If it is not present, unless the finger F is shifted to a considerable extent in the right or left direction on the slanted plane 35*a*, the force to rotate the operation button switch 21 is not generated, which results in poorer operability.

Further, when the right and left operation button switches 21, 21 are operated, the respective outer sides are depressed (the left end in the case of the left operation button switch 21, and the right end in the case of the right operation button switch 21). Thus, the dial section 23 is never simultaneously depressed. Hence, so-called simultaneous pushes of two push buttons are never performed.

That is, the right and left operation button switches 21, 21 can not be pushed towards the rear side (towards the inside of the lower case 4) even if sides of the operation buttons 24, 24 towards the dial sections 23 are depressed, since rotation fulcrums thereof (the button rotation shafts 31, 31) are present on the sides towards the dial section 23. Thus, in operating the right and left operation button switches 21, 21, the finger F depressing them is either already separated from the dial section 23, or at least no force in the direction of depression is applied. Even if the finger F is touching the dial section 23, this can not be depressed towards the rear plane (towards the inside of the lower case 4). Thus, simultaneous pushes of two push buttons are prevented.

The same is also true when the dial section 23 is operated by depression towards the inside of the lower case 4. Even if the finger F touches the right and left operation buttons 24, 24 and even if the dial section 23 can be depressed towards the inside of the lower case 4, the right and left operation button switches 21, 21 are never depressed towards the inside of the lower case 4 because the button rotation shafts 31, 31 obstruct such an operation, and thus prevent simultaneous pushes of two push buttons.

In such a switch device 11, it is preferable that a dimension in the direction of alignment of the respective operators (the dial section 23 and the operation buttons 24, 24) be in a range between 15 mm and 25 mm. This is because the finger F which operates the operators 23, 24, 24 can be inferred to be a thumb given the arrangement structure of the switch device 11 on the portable telephone 1 according to the embodiment described above, and because the width of the thumb in humans is typically 20 mm to 25 mm for an adult male, and 15 mm and 20 mm for an adult female. Thus, operability can further be improved.

For example, if the dimension of the switch device 11 is set to be 20 mm, it is recommended that the dimension of the dial section 23 be set at 9 mm, the dimension of the respective operation button switches 21, 21 at 5.2 mm, the intervals between the dial section 23 and the operation button switches 21 at 0.3 mm, and further that the slanted plane 35*a* of the operation button switch 21 be set at 4.3 mm and the flat plane 35*b* at 0.9 mm.

Also, the dimension in the right and left directions of the switch device 11 can be determined to some extent based on the width dimension of the finger F of humans as mentioned above, but it is preferable to take the width dimension of the portable telephone 1 into consideration as well.

As mentioned above, although the switch device 11 is designed such that the two operation button switches 21, 21 are placed on both sides of the dial section 23, because the three operators (the dial section 23 and the operation button switches 21, 21) are placed close to one another, operability can be improved while it is also possible to reduce the dimension of the switch device in the direction of alignment of the operators. Hence, by employing the switch device 11, not only can the dimension in the right and left directions, with respect to terminal apparatuses such as portable telephones, be reduced, but moreover, it is possible to mount other switches, namely, the push button switches 12, 12 in the embodiment described above and the like.

By the way, in the embodiment described above, the switch device according to the present invention is applied to a device in which the middle operator is a dial section of a jog dial. However, the present invention is not limited as such, and the middle operator may be a push button switch. In short, it is only required that the operation planes of the outer operators placed with the middle operator in between have a slanted plane which becomes higher towards the side farther from the middle operator.

Also, while a device in which the slanted plane of the operation plane of the outer operator is trumpet-shaped is described, the present invention is not limited as such, and the device may be such that it is flat in the upward and downward directions and becomes higher along the outer direction.

In addition, the actual shapes and structures of the respective members illustrated in the above-mentioned embodiments are only examples of reductions to practice in implementing the present invention, and the technical scope of the present invention should not be narrowly construed through them.

As is evident from the above-mentioned explanations, the switch device according to the present invention is a switch device having a middle operator and two outer operators placed closely to one another with the middle operator in between, and it is characterized in that the operation planes of the outer operators are formed on slanted planes which become higher towards the sides farther from the middle operator.

Thus, in the switch device according to the present invention, by simply placing the pad of the finger on the middle operator and then shifting the finger as if to roll it on the middle operator, the adjacent outer operators can be operated, and as a result, by one finger, operability of the switch device having the three operators can be improved.

Also, despite having the above-mentioned structure where the two operation buttons are placed with the middle operator in between, the three operators can be placed close to each other, operability thereof can be improved and moreover, by positioning the three operators close to one another, a dimension of the switch device in the direction of its alignment can be reduced, thus in an electronic apparatus employing such a switch device, not only is it possible to reduce the size thereof, but other switches, namely, the push button switches 12, 12 in the embodiment mentioned above can also be installed, and further multi-functionality can be expected.

The operation planes of the outer operators have the outer ends thereof formed as flat planes continuous with the slanted planes. Thus, when the finger with which the middle operator is operated is shifted to the outer operator, the portion slightly closer to the side than the center of the finger tab is easily caught by the flat plane, and operability of the outer operators can be improved.

The length in the direction of alignment of the three operators is set to be 15 mm to 25 mm, considering the dimensions of the human thumb, operability can optimized.

In addition, another switch device according to the present invention is characterized in that the outer operator is made freely rotatable by being mounted on a rotation shaft which is in a direction substantially orthogonal to the direction of alignment of the three operators, and is also substantially orthogonal to the direction of depression of the operation planes, and in that the rotation shaft is placed on the side of the outer operator adjacent to the middle operator.

Thus, in this other switch device according to the present invention, when the middle operator is operated, the outer operator can not be operated, and when the outer operator is operated, the middle operator can not be operated. Hence, it is possible to prevent so-called simultaneous pushes.

What is claimed is:

1. A switch device having a rotatable and depressible middle operator and two outer operators placed adjacent to the middle operator with the middle operator between the two outer operators, and characterized by having an operation plane of the two outer operators formed on a slanted plane that becomes higher as a distance from the middle operator increases.

2. The switch device according to claim 1, wherein the operation plane of each of the two outer operators has an outer end formed on a flat plane continuous with the slanted plane.

3. The switch device according to claim 1, wherein the switch device has an overall length of between 15 mm and 25 mm in a direction of alignment of the middle operator and the two outer operators.

4. A switch device having a rotatable and depressible middle operator and two outer operators placed adjacent to the middle operator with the middle operator in between, the two outer operators each pivoting about rotation shafts, wherein axes of each of the rotation shafts are substantially orthogonal to a direction of alignment of the middle operator and the two outer operators;

the axes of each of the rotation shafts are substantially orthogonal to a depression direction of operation planes of the middle operator and the two outer operators; and each of the rotation shafts are located on a side of each of the respective two outer operators adjacent to middle operator.

* * * * *